US006395975B1

(12) United States Patent
Bosisio et al.

(10) Patent No.: US 6,395,975 B1
(45) **Date of Patent: *May 28, 2002**

(54) HIGH VOLTAGE DIRECT CURRENT ELECTRICAL CABLE WITH MASS-IMPREGNATED INSULATION

(75) Inventors: Claudio Bosisio, Brembate Sotto; Gianmario Lanfranconi, Capriate San Gervasio; Gianni Miramonti, Magenta; Franco Peruzzotti, Legnano, all of (IT)

(73) Assignee: Pirelli Cavi e Sistemi S.p.A., Milan (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/347,517

(22) Filed: Jul. 2, 1999

Related U.S. Application Data

(60) Provisional application No. 60/094,257, filed on Jul. 27, 1998, now abandoned.

(30) Foreign Application Priority Data

Jul. 6, 1998 (EP) ..... 98112473

(51) Int. Cl.[7] ..... H01B 9/00
(52) U.S. Cl. ..... 174/25 R; 174/120 SC
(58) Field of Search ..... 174/25 R, 102 SC, 174/105 SC, 106 SC, 108, 109, 120 R, 120 SC; 252/511; 428/379, 383

(56) References Cited

U.S. PATENT DOCUMENTS

| | | | | |
|---|---|---|---|---|
| 3,621,110 A | | 11/1971 | McGrath | 174/25 R |
| 3,780,206 A | | 12/1973 | Reynolds | 174/36 |
| 3,935,042 A | * | 1/1976 | Wahl | 174/120 SC X |
| 4,602,121 A | | 7/1986 | Priaroggia | 174/25 R |
| 4,851,060 A | * | 7/1989 | Wade, Jr. et al. | 174/120 R X |
| 5,410,106 A | | 4/1995 | Nishino et al. | 174/105 R |
| 5,497,513 A | * | 3/1996 | Arabeyre et al. | 2/240 |
| 5,688,733 A | * | 11/1997 | Renkema et al. | 502/103 |

FOREIGN PATENT DOCUMENTS

| | | |
|---|---|---|
| EP | 0 233 381 | 8/1987 |
| EP | 0 684 614 A1 | 11/1995 |
| GB | 1045527 | 10/1966 |
| GB | 2196781 | 5/1990 |

* cited by examiner

*Primary Examiner*—Chau N. Nguyen
(74) *Attorney, Agent, or Firm*—Finnegan, Henderson, Farabow, Garrett & Dunner, L.L.P.

(57) ABSTRACT

Mass-impregnated electrical cable, particularly for carrying high voltage direct current, having an insulation in which, around the insulating layer impregnated with an insulating fluid, a containing layer is provided broadly includes at least one winding of a tape of a semiconducting elastomeric material, which exerts an effective action of containing the insulating fluid, while preventing formation of micro-cavities within the impregnated insulating layer. The material constituting the tape has high physical-chemical resistance to the degrading action of the components of the insulating fluid, both in the cold state and, in particular, at the operating temperature of the cable.

19 Claims, 3 Drawing Sheets

HIGH VOLTAGE DIRECT CURRENT ELECTRICAL CABLE WITH MASS-IMPREGNATED INSULATION

CROSS-REFERENCE TO RELATED APPLICATIONS

The present application claims the benefit of provisional application Serial No. 60/094,257 filed Jul. 27, 1998 now abandoned, incorporated herein by reference in its entirety and European patent application number 98 11 2473.8 filed Jul. 6, 1998.

BACKGROUND OF THE INVENTION

1. Field of the Invention

The present invention relates to a cable, particularly for carrying high voltage direct current, and suitable for either terrestrial or, in particular, submarine installations, having as insulating layer a material impregnated with an insulating fluid.

For the purposes of the present description and the claims, with the term "high voltage" it is meant a voltage of at least 100 kV, preferably of at least 200 kV.

2. Related Art

For carrying high voltage direct current, either along terrestrial lines or, in particular, along submarine lines, use is made of cables, commonly known in the art as mass-impregnated cables, in which the conductor, covered with a first semiconducting layer, is electrically insulated by taping with an insulating material, generally paper or multi-layered paper/polypropylene/paper laminates, which is then thoroughly impregnated with a mixture having high electrical resistivity and high viscosity, generally a hydrocarbon oil treated with a viscosity-increasing agent. The cable then comprises a further semiconducting layer and a metal sheath, generally made from lead, which in turn is surrounded by at least one metal armouring structure and one or more protective sheaths made from plastic material.

Although characterized by high reliability in operation even at very high voltages (above 150 kV), mass-impregnated cables have some disadvantages, principally relating to the migration of the insulating fluid within the cable. In particular, during use the cable is subject, owing to variations in the carried current intensity, to thermal cycles which cause migration of the impregnating fluid in radial direction. This is because, when the carried current increases and the cable heats up, the insulating fluid decreases in its viscosity and is subject to a thermal expansion greater than that of all the other components of the cable. This causes a migration of the fluid from the insulating layer towards the exterior, and consequently an increase of the pressure exerted on the metal sheath, which is deformed in the radial direction. When the carried current decreases and the cable cools, the impregnating fluid contracts, while the metal sheath, being constituted by a plastic material (usually lead), remains permanently deformed. Thus there is a decrease of the pressure inside the cable, which causes formation of micro-cavities in the insulating layer, with consequent risk of electrical discharges and therefore of insulation piercing. The risk of piercing increases with an increase of the insulating layer thickness and therefore with an increase of the maximum voltage for which the cable has been designed.

For carrying direct current at high voltage, pressurized cables have been developed, wherein the insulating layer impregnated with the insulating fluid is subjected to a pressure greater than atmospheric pressure, generally above 14 bars, by introducing a pressurized gas, for example nitrogen. Another solution for carrying high voltage direct current consists of fluid oil cables, in which insulation is provided by a pressurized oil with low viscosity and high resistivity (under hydrostatic head). These solutions, although very effective in preventing formation of micro-cavities in the cable insulation, have various disadvantages mainly related to construction complexity, and in particular they cause a limitation of the maximum admissible cable length (generally of not more than 50–100 km). This limitation of the maximum length is a serious drawback, especially in the case of submarine installations, where the required lengths are usually very great.

In Patent GB-2,196,781 a direct current mass-impregnated cable is described, in which a reinforcing structure is present consisting of an elastic tape wound tightly around the metal sheath so as to compensate for radial expansions and contractions of the impregnating oil and consequently to prevent formation of micro-cavities in the insulation. The tape consists of an elastic material of a metal or polymer type, characterized by mechanical hysteresis cycles of the closed type, with a low permanent deformation after thermal cycles.

Patent EP-233,381 describes a high voltage mass-impregnated cable comprising a pressure body consisting of a supporting layer, disposed on the outside of the metal sheath, around which is wound, in at least two overlapping layers, a thin elastic tape made from metal or polymer material. The presence of the supporting layer interposed between the metal sheath and the elastic tape acts as a "bedding", preventing the tape, which is wound with high tension to exert a sufficient containing action on the metal sheath, from damaging the sheath or from eventually causing it to fracture. The risk of fracture increases when the cable overheats, partly owing to the fact that the lead constituting the sheath becomes more malleable, and partly because the cable expands and therefore the tape tension increases.

In the Applicant's perception, both the solutions proposed in the aforesaid patents GB-2,196,781 and EP-233,381 have several drawbacks arising from the fact that the containing tape is disposed on the outside of the metal sheath. Indeed, as explained above, the tension exerted by the tape may damage the sheath and even cause it to fracture, and on the other hand the interposition of a supporting layer between the tape and the sheath, as proposed in patent EP-233,381, not only makes the cable construction more complex, but also decreases effectiveness of the containing action exerted by the said tape on the sheath.

Moreover, the high pressures required to achieve the desired return of the metal sheath during the thermal contraction phase cause a rapid wear of the containing tape, owing to the friction between tape and sheath and between the turns of the tape itself. Finally, the containing tape, being applied externally to the sheath, is subject to the action of external agents, particularly water which may infiltrate under the armour, and this causes a degradation over time of its elastic and mechanical properties.

SUMMARY OF THE INVENTION

The Applicant has now found that it is possible to achieve an effective action of containing of the insulating fluid, thus preventing formation of micro-cavities inside the impregnated insulating layer, by winding around the insulating layer beneath the metal sheath at least one tape made from elastomeric semiconducting material, which exerts a compressive action on the insulating layer and acts as a barrier with respect to the radial migration of the insulating fluid without damaging the metal sheath. By contrast with the solutions known in the art, according to the present invention the action of containing of the impregnating fluid is exerted directly on the insulating layer, so that the formation of micro-cavities in the insulation is avoided, even if empty spaces are formed between the cable core and the metal sheath.

The semiconducting properties of the elastomeric material ensure electrical continuity by preventing the creation of potential differences between the core of the cable and the metal sheath, which would lead to electrical discharges and consequently to perforation of the cable. Moreover, the material constituting the tape has a high physical-chemical resistance to the degrading action exerted by the components of the insulating fluid, both in the cold state and, in particular, at the cable operating temperature. This is because the insulating fluid, usually consisting of products of the hydrocarbon type, may cause, especially when hot, a swelling of the elastomeric material and consequently a gradual degradation of elastic and semiconducting properties of the material, with a loss of functionality of the containing layer over time.

DESCRIPTION OF THE SEVERAL VIEWS OF THE DRAWING

The attached figures show an embodiment of the cable according to the present invention, wherein.

DETAILED DESCRIPTION OF THE INVENTION

Figure 1:
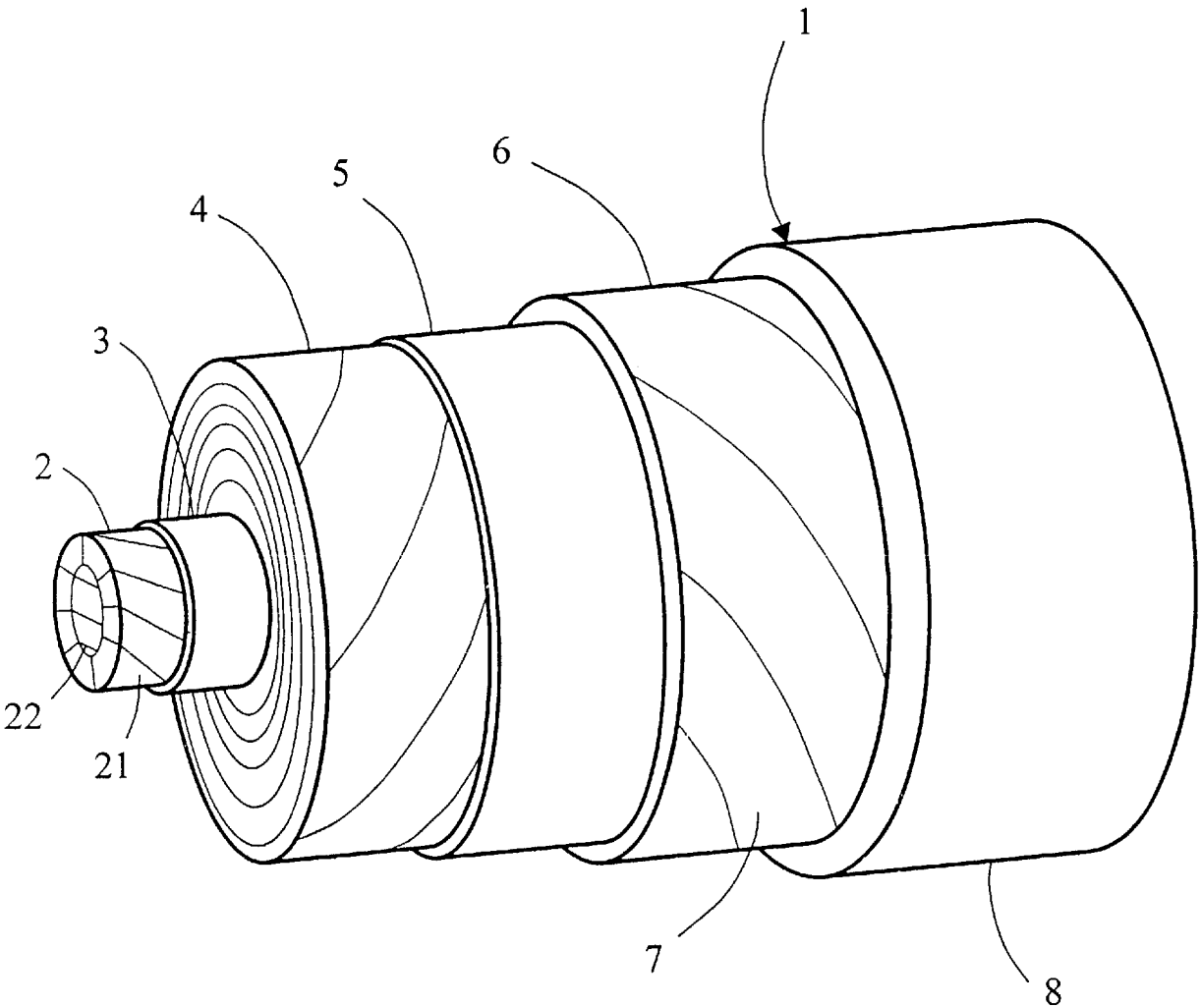
FIG. 1 shows a perspective view of a section of a cable according to the present invention with portions partially removed to show its structure.
Figure 2:
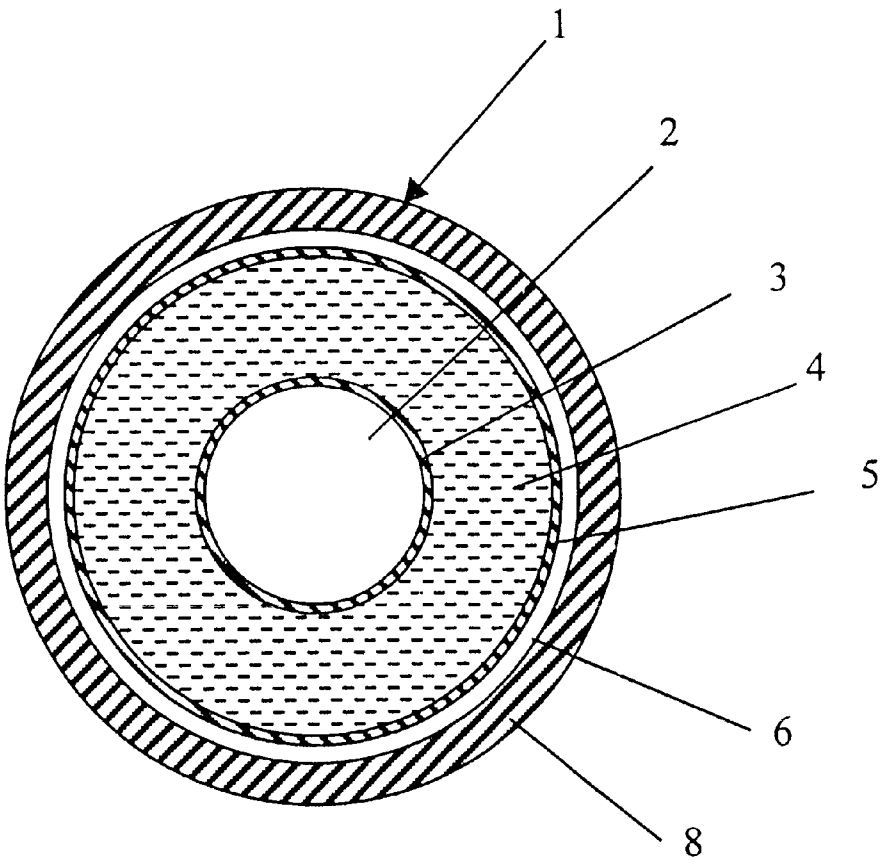
FIG. 2 shows a transverse section through the cable shown in FIG. 1.

In a first aspect, the present invention therefore relates to a cable, particularly for high voltage direct current, comprising an electrical conductor, at least one semiconducting layer, a stratified insulating layer impregnated with an insulating fluid, and a metal sheath disposed on the outside of the said insulating layer, characterized in that between the said insulating layer and the said metal sheath a layer for containing the insulating fluid is provided, comprising at least one winding of a tape made from a semiconducting elastomeric material having a predetermined physical-chemical resistance with respect to the insulating fluid.

In a preferred embodiment, the cable according to the present invention comprises an inner semiconducting layer disposed between the conductor and the insulating layer, and an outer semiconducting layer disposed between the insulating layer and the containing layer.

The physical-chemical resistance of the elastomeric material with respect to the insulating fluid is predetermined so that the elastomeric material, when brought into contact with the insulating fluid, has a low tendency to swell and therefore maintains its elastic and semiconducting properties within values so as to ensure, in normal conditions of use and for a predetermined period of time, preferably throughout the life of the cable, the desired containing action on the insulating layer on the one hand, and the electrical continuity between the cable core and the metal sheath on the other hand.

In a further aspect, the present invention relates to a method for preventing, in a mass-impregnated electrical cable comprising a stratified insulating layer impregnated with an insulating fluid, formation of micro-cavities within the insulating layer, said method comprising winding a tape of an elastomeric material around the said layer so as to form a containing layer for the insulating fluid around the insulating layer.

In a preferred embodiment of the aforesaid method, the tape made from the elastomeric material is disposed between the insulating layer and a metal sheath and has semiconducting properties such that electrical continuity is ensured between the insulating layer and the metal sheath.

To evaluate the physical-chemical resistance of the elastomeric material to the degrading action of the insulating fluid, the Applicant has developed an accelerated ageing test, in which a test specimen of the elastomeric material, put under tension with a predetermined value of percentage elongation, is immersed in the insulating fluid at a predetermined temperature and for a predetermined time. At the end of the ageing period, the test specimen is released, and the permanent percentage elongation, namely the difference in per cent between the length after ageing and the initial length of the test specimen, is determined. The permanent percentage elongation is measured immediately after the release of the test specimen, in other words without allowing the test specimen to recover, at least partially, the initial dimensions over a period of time.

Therefore, the measurement of the permanent percentage elongation constitutes a method for evaluating the residual capacity for elastic recovery after ageing, which must be such as to ensure a sufficient radial compressive force on the impregnated insulating layer in the presence of thermal cycles of expansion and contraction which the cable undergoes during use.

On the basis of the experiments carried out by the Applicant, it is believed, in particular, the elastomeric material has the desired resistance to degradation of the elastic properties due to contact with the insulating fluid if a test specimen of the material, kept under tension with an imposed elongation of 50% and immersed in the insulating fluid for 360 days at 85° C., has a permanent elongation of less than 35%, preferably less than 25%.

This quantitative indication is provided purely for illustrative purposes, and it is possible for a person skilled in the art to find different criteria which can be used to evaluate the physical-chemical resistance of the elastomeric material with respect to the insulating fluid as a function of the specific design of the cable to be made, the materials used and the operating conditions of the cable.

The elastomeric base material to be used for making the containing layer according to the present invention may be selected, for example, from: nitrile rubbers, styrene rubbers, fluoroelastomers, silicone rubbers, ethylene/propylene (EPR) or ethylene/propylene/diene (EPDM) elastomers, elastomeric copolymers of ethylene with ethylenically unsaturated esters, polychloro-sulphonated or polychlorinated elastomers, and the like, or mixtures thereof. The following are particularly preferred:

- butadiene/acrylonitrile copolymers, particularly butadiene/acrylonitrile copolymers with a high content of acrylonitrile (generally from 20% to 45% by weight of acrylonitrile), preferably in an at least partially hydrogenated form;
- ethylene/vinylacetate, ethylene/methylacrylate, ethylene/ethylacrylate or ethylene/butylacrylate copolymers with a high ester content (generally from 28% to 80% by weight);

fluoroelastomers based on tetrafluoroethylene and/or vinylidene fluoride with hexafluoropropene and/or perfluorovinyl ethers;

polychloroethylene, polychlorosulphonylethylene, polychloroprene, and the like.

The elastomeric material may be vulcanized by known methods, for example by sulphur cross-linking, or via radicals. Preferably, elastomeric materials having a high cross-linking degree are used, so as to achieve high elastic performance. Preferably, the elastomeric material as such (i.e. before ageing in contact with the insulating fluid) has stress at break greater than 15 MPa, preferably greater than 20 MPa, elongation at break greater than 300%, preferably greater than 400%, and modulus at 100% greater than 3 MPa, preferably greater than 3.5 MPa.

To impart semiconducting properties to the elastomeric material, it is possible to use products known in the art for the preparation of semiconducting polymer compositions. In particular, an electrically conducting carbon black may be used having a surface area generally greater than 20 $m^2/g$, for example electroconducting acetylene or furnace black, and the like, or also high-conductivity carbon black, having for example a surface area of at least 900 $m^2/g$.

The amount of carbon black to be added to the mixture is such as to impart sufficient semiconducting properties to the final elastomeric material, and in particular to provide a volume resistivity of the elastomeric material, measured at ambient temperature, of less than 100 Ω·m, preferably less than 5 Ω·m. Typically, the quantity of carbon black may vary from 5 to 70%, preferably from 10 to 50%, by weight with respect to the weight of the polymer.

Other additives of various kinds known in the art, such as plasticizers, antioxidants, cross-linking accelerators, co-vulcanizing agents, etc., are usually added to the polymer mixture.

With reference to the aforesaid figures, the cable (1) according to the present invention comprises, in sequence from the centre to the exterior, a conductor (2), an inner semiconducting layer (3), a stratified insulating layer (4), an outer semiconducting layer (5), a containing layer (6) comprising one or more tapes (7) of elastomeric material wound around the outer semiconducting layer (5), and a metal sheath (8).

The conductor (2) generally consists of a plurality of single conductors, preferably made from copper or aluminium, for example in the form of wires stranded together by conventional methods, or, preferably, is of the copper-wedge or Milliken type (as shown in FIG. 1), in which a plurality of metal conductors (21) are joined together so as to form individually insulated sectors in order to minimize stray currents. A duct (22) allowing the insulating fluid to move longitudinally along the cable may be present in the centre of the conductor (2).

Around the conductor (2) there is a layer (3) having semiconducting properties, consisting, for example, of windings of cellulose paper tapes filled with semiconducting carbon black.

The insulating layer (4) generally consists of windings of cellulose paper tapes, having a density typically in the range of from 0.7 to 1.2 $g/cm^3$, preferably from 0.9 to 1.1 $g/cm^3$. Instead of the cellulose paper, paper/polypropylene/paper laminates may be used as described, for example, in patents GB-1,045,527 and U.S. Pat. No. 4,602,121, or in patent application EP-684,614.

The windings of the insulating layer (4) are impregnated with an insulating fluid generally having a viscosity of from 50 to 300 cSt at 100° C., and of from 500 to 10,000 cSt at 60° C., and an electrical resistivity generally greater than $1 \cdot 10^{14}$ Ω·m. Fluids of this type generally consist of a mineral oil of naphthenic or paraffin type, or mixtures thereof, to which a viscosity-increasing agent is added in amounts usually of from 0.5% to 10% by weight, preferably from 1% to 5% by weight. The viscosity-increasing additives may be selected, for example, from: high molecular weight polyolefins, for example polyisobutenes; polymerized colophonic resins; micro-crystalline wax; elastomeric materials in a subdivided form, for example styrene or isoprene rubbers; and similar.

The containing layer (6) is formed around the outer semiconducting layer (5) by spirally winding the tape (7) made from the elastomeric material as described above. The surface of the tape is as smooth and defect-free as possible, so that optimal contact between overlapping turns of the tape is achieved, and therefore infiltration of insulating fluid is prevented.

Figure 3:
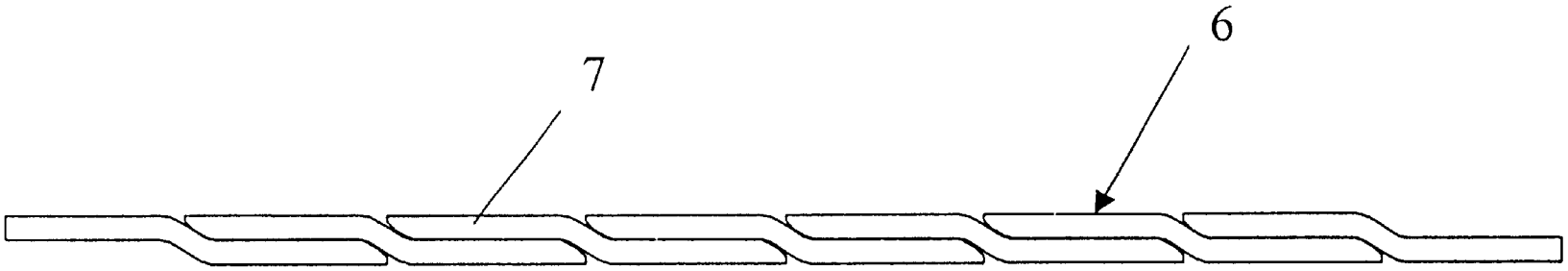
FIGS. 3 and 4 show a schematic sectional representation of two possible embodiments of the taping with the elastomeric material.

The winding preferably consists of one or more layers of the tape wound with an overlap between successive turns of at least 20%, preferably at least 50%, with respect to the tape width, so that the possibility of infiltration of the impregnating fluid between one turn and the next is prevented. An overlap of this type ensures a certain safety margin in preventing formation of empty spaces between the turns as a result of possible irregularities in the taping process. An embodiment with a tape layer wound with an overlap of about 50% is shown schematically in FIG. 3.

Figure 4:
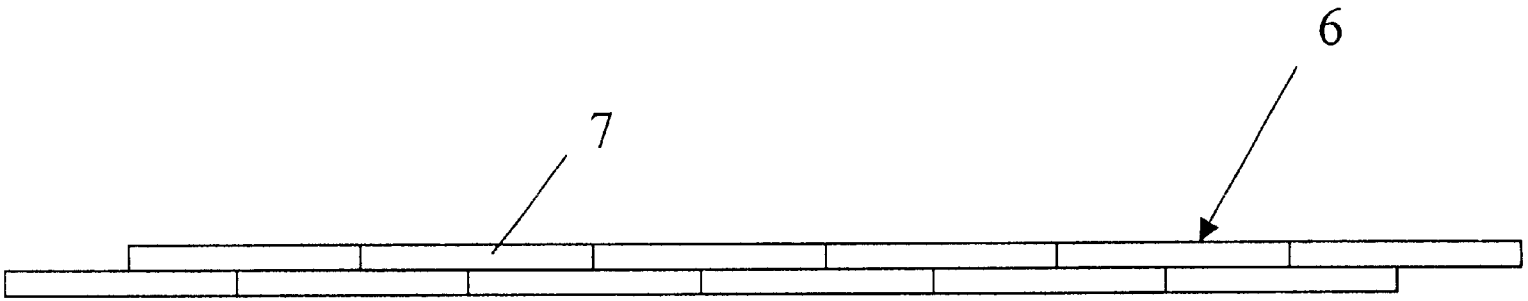

An alternative embodiment is shown schematically in FIG. 4, wherein the containing layer comprises at least two tape layers (7) wound spirally with turns abutting each other without substantial overlap, this being done in such a way that the separating line between turns of one layer does not overlap the separating line between turns of the adjacent layer or layers. It should be noted that, to ensure tightness against any infiltration of the insulating fluid, this type of taping requires greater accuracy in the tape application than the solution shown in FIG. 3.

Width and winding pitch of the tape (7) are predetermined mainly with respect to the cable dimensions. Typically, the tape may have a width of from 20 to 80 mm and may be wound with a pitch of from 10 to 80 mm.

The total thickness of the containing layer (6) is predetermined with respect both to the elastic characteristics of the elastomeric material used and to the specific structure and dimensions of the cable which is to be made, and is usually in the range of from 1 to 8 mm, preferably from 2 to 5 mm.

During the process of winding around the cable core, a traction force is applied to the tape so as to exert on the underlying layers a radial pressure sufficient to obtain an effective action of containment of the impregnating fluid. In general, the tape is wound with a traction force such that an elongation of the tape generally of from 40% to 90%, preferably of from 50% to 70%, is obtained.

The metal sheath (8), usually made from lead or lead alloys, encloses the cable core consisting of the aforementioned elements, and any space within the sheath (8) is filled by the insulating fluid so as to thoroughly impregnate the cable layers, and in particular the stratified insulating layer (4).

Around the sheath (8) an armoured structure (not shown in the figures) is disposed, capable of protecting the cable from the high hydrostatic pressures to which it is subjected during use in submarine applications. This armoured structure may comprise, for example, a sheath made from plastic material to which a metal sheath, made e.g. from steel wires, is applied, which in turn is protected by an external sheath, also made from a plastic material. The armoured structure may also comprise one or more layers of padding to prevent the metal armour from damaging the adjacent layers.

An example of a polymer mixture suitable for making the containing layer according to the present invention is as follows:

| | |
|---|---|
| nitrile rubber (NBR): butadiene/acrylonitrile copolymer (33% acrylonitrile by weight), having Mooney viscosity ML (1 + 4) at 100° C. = 45 ± 5 (product Krynac ® 34-50 by Bayer); | 50.0% by weight |
| liquid nitrile rubber (plasticizer), having a Brookfield viscosity of 20,000–30,000 cP (at 12 rpm, 50° C., needle no. 4) | 10.7% by weight |
| conducting carbon black: product Vulcan ® XC 72 by Cabot; | 32.0% by weight |
| sulphur (cross-linking agent): product Rhenogran ® S-80 (80% sulphur pre-dispersion) by Rhein Chemie; | 0.6% by weight |
| zinc oxide (co-vulcanizing agent): product Zinc Oxide S.O. by A-Esse; | 5.0% by weight |
| tetramethylthiuram disulphide (TMTD) (vulcanization accelerator): product Rhenogran ® TMTD-80 (pre-dispersion with 80% TMTD) by Rhein Chemie; | 1.5% by weight |
| 2,2,4-trimethyl-1,2-dihydroquinoline (TMQ) (antioxidant): product Anox ® HB by Great Lakes. | 0.2% by weight |

The mixture was prepared by means of a Banbury mixer, then calendered and cross-linked by heating at 160° C. for 30 minutes. From the so produced sheet, dumb-bell test specimens with dimensions 90×15×15 mm were prepared. On a test specimen in the initial state, volume resistivity (by means of a Metra Hit 16 multimeter by ABB) and mechanical properties (by means of instrument Instron 1122, with a traction rate of 25 mm/min.) were determined. The test specimens were subjected to traction with an elongation of 50% and kept immersed in an insulating fluid for predetermined increasing periods at a temperature of 85° C. The fluid is of the type commonly used for mass-impregnated cables (commercial product T2015 by Dussek-Campbell), based on mineral oil with the addition of approximately 2% by weight of a high molecular weight polyisobutene as viscosity-increasing agent.

At the end of each period of immersion, one test specimen was removed from the insulating fluid, left to cool to ambient temperature (still under traction), and cleaned with petroleum ether so as to eliminate fluid residues, and its volume resistivity was measured as indicated above. After removing the traction force, permanent elongation was immediately measured and the mechanical properties were then determined as indicated above. Another set of test specimens was subjected to the same measurements in the conditions indicated above, but with an imposed elongation of 75%.

The results of the two sets of tests are shown in Tables 1 and 2. These results clearly demonstrate that the elastomeric material used maintains its elastic properties within satisfactory values even after prolonged immersion in the insulating fluid at high temperature in stretching conditions.

TABLE 1

| Period of immersion in T2015 (days) | Imposed elongation: 50% Resistivity (Ω m) | Permanent elongation (%) | Stress at break (MPa) | Elongation at break (%) | Modulus at 100% (MPa) |
|---|---|---|---|---|---|
| 0 | 0.85 | — | 21.0 | 435 | 4.0 |
| 30 | 0.66 | 14.4 | 16.4 | 330 | 4.83 |
| 60 | 1.03 | 11.1 | 16.2 | 310 | 4.4 |
| 120 | 0.88 | 18.8 | 16.1 | 280 | 4.5 |
| 150 | 2.07 | 19.0 | 14.7 | 230 | 4.51 |
| 240 | 3.10 | 24.0 | 14.0 | 220 | 4.7 |
| 360 | 2.91 | 23.0 | 14.1 | 230 | 4.75 |

TABLE 2

| Period of immersion in T2015 (days) | Imposed elongation: 75% Resistivity (Ω m) | Permanent elongation (%) | Stress at break (MPa) | Elongation at break (%) | Modulus at 100% (MPa) |
|---|---|---|---|---|---|
| 0 | 0.85 | — | 21.0 | 435 | 4.0 |
| 30 | 0.70 | 24.4 | 21.4 | 335 | 4.4 |
| 60 | 1.20 | 18.8 | 19.5 | 360 | 4.3 |
| 120 | 1.75 | 33.3 | 15.1 | 250 | 4.5 |
| 150 | 3.29 | 43.0 | 16.1 | 220 | 4.6 |
| 240 | 2.80 | 45.5 | 14.7 | 220 | 4.6 |
| 360 | 2.70 | 44.6 | 14.8 | 230 | 4.7 |

What is claimed is:

1. Cable, particularly for carrying high voltage direct current, comprising an electrical conductor, at least one semiconducting layer, a stratified insulating layer impregnated with an insulating fluid, and a metal sheath disposed on the outside of said insulating layer, characterized in that between said insulating layer and said metal sheath a layer for containing said insulating fluid is provided, comprising at least one winding of a tape made from a semiconducting elastomeric material having physical-chemical resistance with respect to said insulating fluid, said elastomeric material being such that a test specimen of said elastomeric material, kept under traction with an imposed elongation of 50% and immersed in said insulating fluid for 360 days at 85° C., has a permanent elongation of less than 35%.

2. Cable according to claim 1, wherein said at least one semiconducting layer comprises an inner semiconducting layer disposed between the conductor and the insulating layer, and an outer semiconducting layer disposed between the insulating layer and the containing layer.

3. Cable according to claim 1, wherein said test specimen of said elastomeric material, kept under traction with an imposed elongation of 50% and immersed in said insulating fluid for 360 days at 85° C., has a permanent elongation of less than 25%.

4. Cable according to claim 1, wherein the elastomeric material includes: nitrile rubbers, styrene rubbers, fluoroelastomers, silicone rubbers, ethylene/propylene (EPR) or ethylene/propylene/diene (EPDM) elastomers, elastomeric copolymers of ethylene with ethylenically unsaturated esters, polychlorosulphonated or polychlorinated elastomers, or mixtures thereof.

5. Cable according to claim 4, wherein the elastomeric material is a butadiene/acrylonitrile copolymer with a high content of acrylonitrile.

6. Cable according to claim 5, wherein the butadiene/acrylonitrile copolymer is at least partially hydrogenated.

7. Cable according to claim 4, wherein the elastomeric material is an ethylene/vinylacetate, ethylene/ methylacrylate, ethylene/ethylacrylate or ethylene/butylacrylate copolymer having a high ester content.

8. Cable according to claim 4, wherein the elastomeric material is a fluoroelastomer based on tetrafluoroethylene, vinylidene fluoride or combinations thereof with hexafluoropropene or, perfluorovinyl ethers or combinations thereof.

9. Cable according to claim 4, wherein the elastomeric material is polychloroethylene, polychlorosulphonyl ethylene, or polychloroprene.

10. Cable according to any one of claims 4 to 9, wherein the elastomeric material is vulcanized by sulphur cross-linking.

11. Cable according to any one of claim 4 to 9, wherein the elastomeric material is vulcanized by radicals.

12. Cable according to claim 1, wherein the elastomeric material has a stress at break greater than 15 MPa, an elongation at break greater than 300%, and a modulus at 100% greater than 3 MPa.

13. Cable according to claim 1 or claim 2, wherein the containing layer consists of one or more layers of the tape of the elastomeric material wound with an overlap between successive turns of at least 20% with respect to the tape width.

14. Cable according to claim 13, wherein the containing layer consists of one or more layers of the tape of the elastomeric material wound with an overlap between successive turns of at least 50% with respect to the tape width.

15. Cable according to claim 1 or claim 2, wherein the layer for containing the insulating fluid comprises at least two layers of said tape wound spirally with turns abutting each other without substantial overlap.

16. Cable according to claim 1, wherein the tape of the elastomeric material is wound with a tradition force such that an elongation of the tape of from 40% to 90% is obtained.

17. Cable according to claim 16, wherein the tape of the elastomeric material is wound with a traction force such that an elongation of the tape of from 50% to 70% is obtained.

18. In a mass-impregnated electrical cable comprising a stratified insulating layer impregnated with an insulating fluid, a method for preventing formation of micro-cavities within said insulating layer, said method comprising winding a tape of an elastomeric material around said layer so as to form a containing layer for said insulating fluid around said insulating layer, said elastomeric material has physical-chemical resistance with respect to said insulating fluid such that a test specimen of said elastomeric material, kept under traction with an imposed elongation of 50% and immersed in said insulating fluid for 360 days at 85° C., has a permanent elongation of less than 35%.

19. Method according to claim 18, wherein the tape made from the elastomeric material is disposed between the insulating layer and a metal sheath and has semiconducting properties such that electrical continuity is ensured between the insulating layer and the metal sheath.

* * * * *

UNITED STATES PATENT AND TRADEMARK OFFICE

CERTIFICATE OF CORRECTION

PATENT NO. : 6,395,975 B1
DATED : May 28, 2002
INVENTOR(S) : Claudio Bosisio et al.

It is certified that error appears in the above-identified patent and that said Letters Patent is hereby corrected as shown below:

Column 10,
Line 4, “tradition” should read -- traction --.

Signed and Sealed this

Twenty-third Day of July, 2002

*Attest:*

*Attesting Officer*

JAMES E. ROGAN
*Director of the United States Patent and Trademark Office*